US007543521B1

(12) United States Patent
Liu et al.

(10) Patent No.: US 7,543,521 B1
(45) Date of Patent: Jun. 9, 2009

(54) FAST ADJUSTABLE SPANNER

(76) Inventors: Kuan Jung Liu, No. H, 2nd Lin, Hsin Chung Tsun, Ming Hsiung, Hsiang, Chiayi Hsien (TW) 62149; Yen Chun Heng, No. 52, Cingdao 1st St., North District, Taichung City (TW) 40464; Chung Pang Heng, No. 52, Cingdao 1st St., North District, Taichung City (TW) 40464

( * ) Notice: Subject to any disclaimer, the term of this patent is extended or adjusted under 35 U.S.C. 154(b) by 0 days.

(21) Appl. No.: 12/000,586

(22) Filed: Dec. 14, 2007

(51) Int. Cl.
*B25B 13/22* (2006.01)

(52) U.S. Cl. ..... 81/145; 81/129; 81/129.5; 81/146

(58) Field of Classification Search ..... 81/129, 81/129.5, 145, 146
See application file for complete search history.

(56) References Cited

U.S. PATENT DOCUMENTS 1,402,686 A * 1/1922 Trabold ..... 81/157
2,724,301 A * 11/1955 Parent et al. ..... 81/145
2,970,502 A * 2/1961 Nordgren ..... 81/126
5,209,144 A * 5/1993 Lu Guoji ..... 81/165

* cited by examiner

*Primary Examiner*—Joseph J Hail, III
*Assistant Examiner*—Shantese McDonald
(74) *Attorney, Agent, or Firm*—Rosenberg, Klein & Lee

(57) ABSTRACT

A fast adjustable spanner comprises a body of which an action side is provided with a protruding stationary jaw of which a bottom is formed with a glide path communicating with an accommodation slot provided in the body; a movable jaw provided with a sheath fringe corresponding to the glide path on which the adjustable jaw may transversally move, a tooth portion being provided at a bottom of the sheath fringe; a working part provided in the accommodation slot to lengthways move, a protruding joint portion being above the working part and having a screw; at least one elastic part between the working part and the accommodation slot, supporting the working part for wedging the screw to the tooth portion of adjustable jaw; thus, when being compressed with an external force, the elastic part is separate from the tooth portion of adjustable jaw for fast adjusting the movable jaw.

4 Claims, 8 Drawing Sheets

FAST ADJUSTABLE SPANNER

BACKGROUND OF THE INVENTION

1. Field of the Invention

This invention relates to a hand tool and particularly to a spanner fast adjustable.

2. Description of Related Art

As shown in FIG. 9, a conventional adjustable spanner 1 is structured with a body 2 and an adjustable jaw 3, in which a tooth row 4 is formed at a bottom of the adjustable row 3, a thru hole 5 is formed passing through the body 2, and a spiral part 6 is provided pivoting in the thru hole 5 and joined together with the tooth row 4 of the adjustable jaw 3; thus, when the spiral part 6 is revolved, the tooth row 4 of the adjustable jaw 3 is simultaneously driven and the jaw 3 is made to transversally move. However, when adjusting the adjustable jaw 3 of the conventional adjustable spanner 1 for a position, an operator must turn the spiral part 6 to drive the tooth row of adjustable jaw 3 and thus drive the adjustable jaw 3 to move slowly. However, it is a quite troublesome and time-consuming manner of adjustment and cannot form a size demanded by the operator.

Consequently, because of the technical defects of described above, the applicant keeps on carving unflaggingly through wholehearted experience and research to develop the present invention, which can effectively improve the defects described above.

SUMMARY OF THE INVENTION

This invention is mainly to an improved structure of a spanner adjustable for a predetermined position.

In order to achieve the object mentioned above, in this invention, a spanner fast adjustable is provided, comprising a body of which an action side is provided with a protruding stationary jaw of which a bottom is formed with a glide path communicating with an accommodation slot provided in the body; an adjustable jaw provided with a sheath fringe corresponding to the glide path on which the adjustable jaw may transversally move, in which a tooth portion is provided at a bottom of the sheath fringe; a working part provided in the accommodation slot of the body to lengthways move, in which a protruding joint portion is provided above the working part and provided with a screw; at least one elastic part provided between the working part and the accommodation slot and used to support the working part for wedging the screw to the tooth portion of adjustable jaw.

Thus, when being compressed with an external force, the elastic part is separate from the tooth portion of adjustable jaw for fast adjusting the movable jaw.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
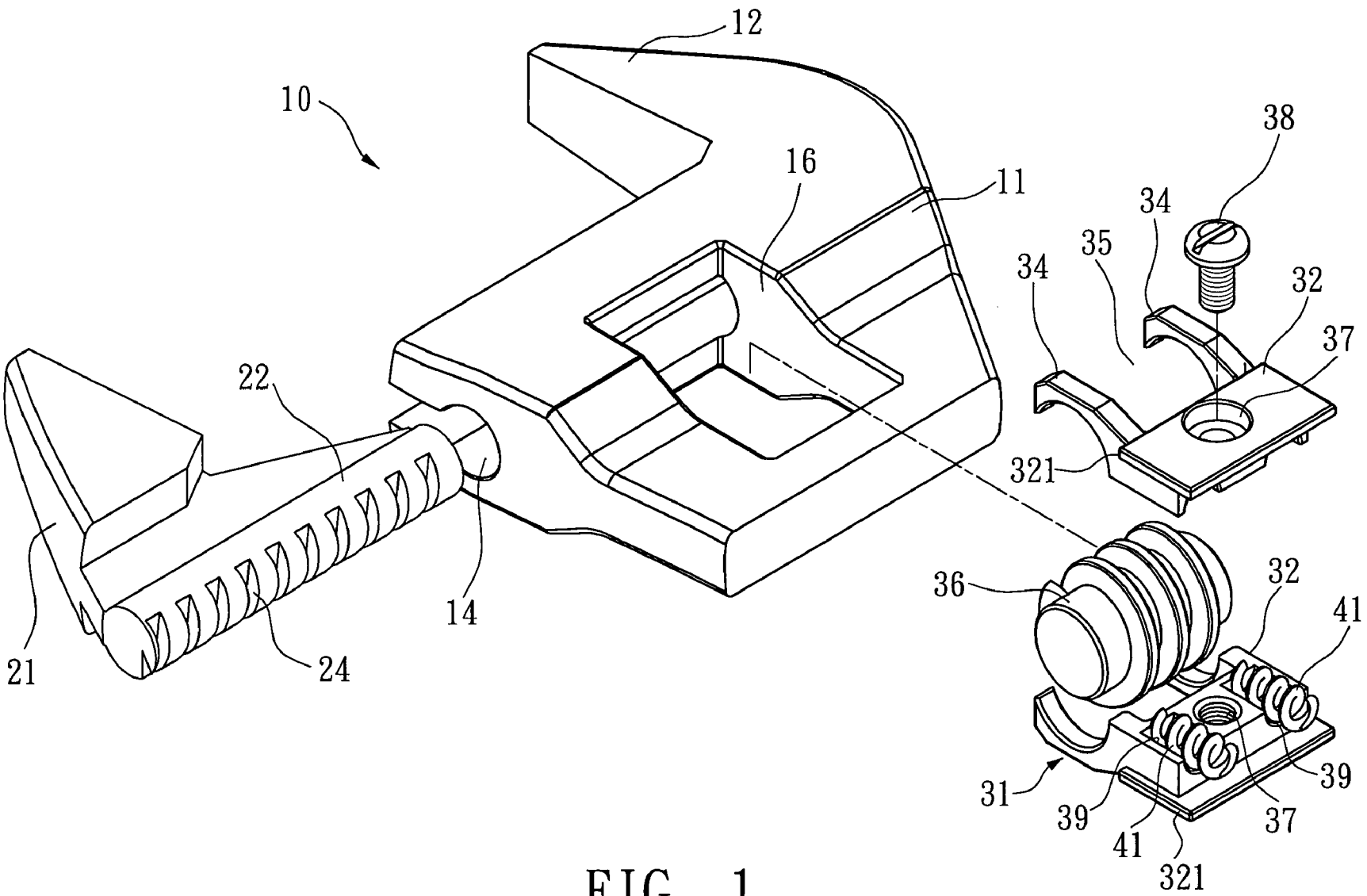
FIG. 1 is a 3D exploded view of this invention.

With reference to FIG. 1, in this invention, a fast adjustable spanner 10 is provided, comprising a body 11, a movable jaw 21, a working part 31, and two elastic parts 41.

An action side of the body 11 is provided with a protruding stationary jaw 12 of which a bottom is formed with a transversal glide path 14. The glide path 14 of the body 11 is a thru hole in a around shape of C, and an accommodation slot 16 is provided in the body 11 and communicates with the glide path 14.

The movable jaw 21 is provided with a sheath fringe 22 corresponding to the glide path 14, in which the sheath fringe 22 is in a shape of pillar. The sheath fringe 22 of the movable jaw 21 is used to cover the glide path 14 of the body 11 so that the movable jaw 21 may glide on the glide path 14 of the body 11, in which a tooth portion 24 is formed at a bottom of the sheath fringe 22.

The working part 31 is provided in the accommodation slot 16 of the body 11 to lengthways move, in which the working part 31 is formed with two flakes 32 symmetrical to each other and respectively formed with two protruding clip arms 34. When the two flakes 32 are connected to each other, each of the clip arms 34 is formed into a joint portion 35 through which a screw 36 is provided to pass and pivot in the portion 35. Further, a stationary hole 37 is formed to pass through each of the two flakes 32 of the working part 31. A stationary part 38 is used to pass through the stationary hole 37 of each of the two flakes 32 so that the two flakes 32 may be connected to each other, a longitudinal groove 39 is formed at each of two inner sides of the flakes 32, and an exterior portion 321 of which a size is larger than an internal diameter of the accommodation slot is provided at each of two sides of the working parts 31 formed from the two flakes 32. When the working part 31 is provided in the accommodation slot 16, the exterior portions at the two sides of the working part 31 are close to external sides of the accommodation slot 16, and thus the working part 31 does not get out of the accommodation slot 16.

The two elastic parts 41 are respectively provided in the longitudinal grooves 39 at the two inner sides of the working part 31. A terminal of the elastic part 41 is used to support a side fringe of the longitudinal groove 39 of the working part 31, while the other terminal is used to support a root edge of the accommodation slot 16 of the body 11. The elastic part 41 is used to support the working part 31 so that the screw 36 of the working part 31 may wedge to the tooth portion 24 of the movable jaw 21.

Figure 2:
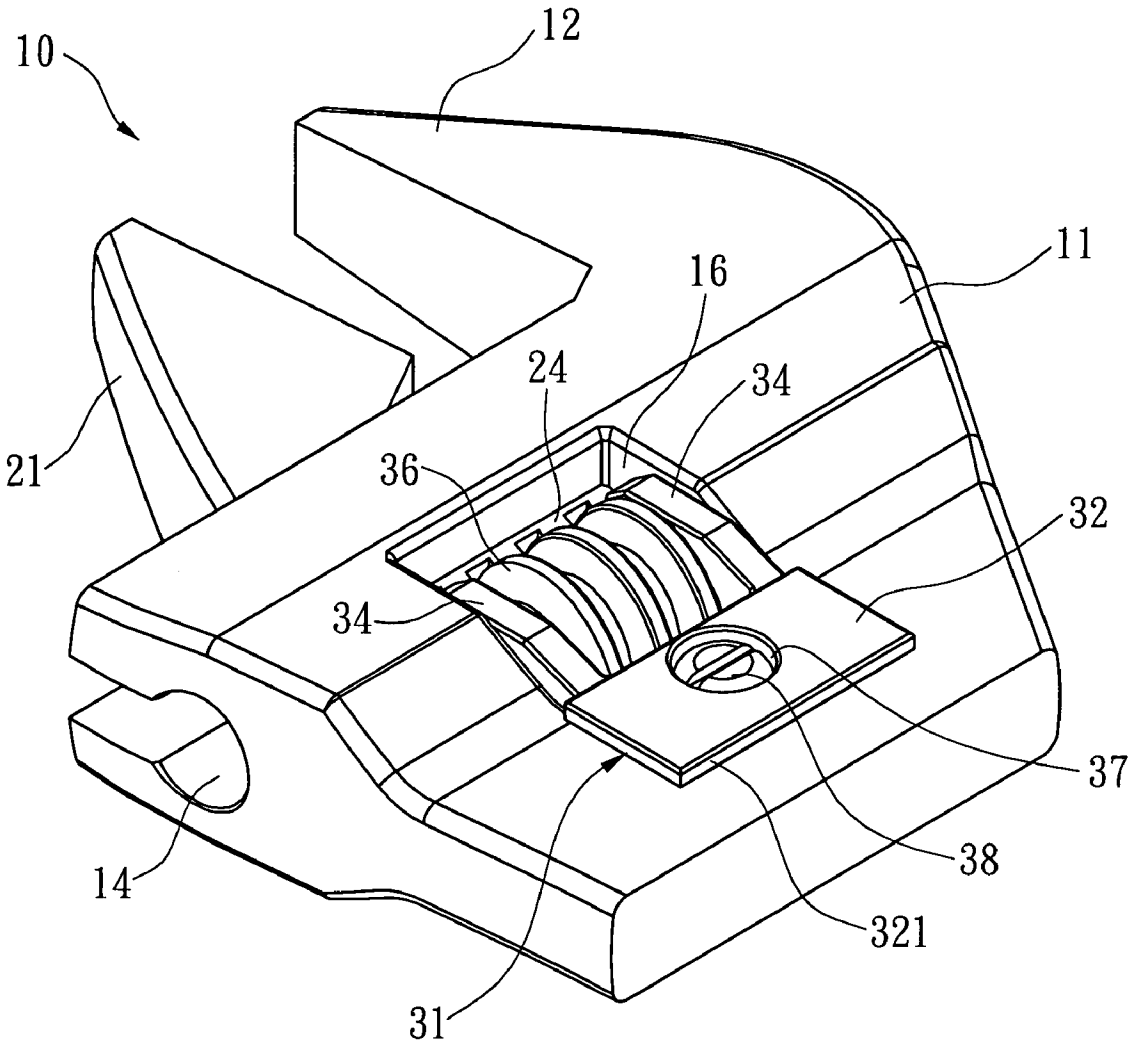
FIG. 2 is a 3D assembly view of this invention.
Figure 3:
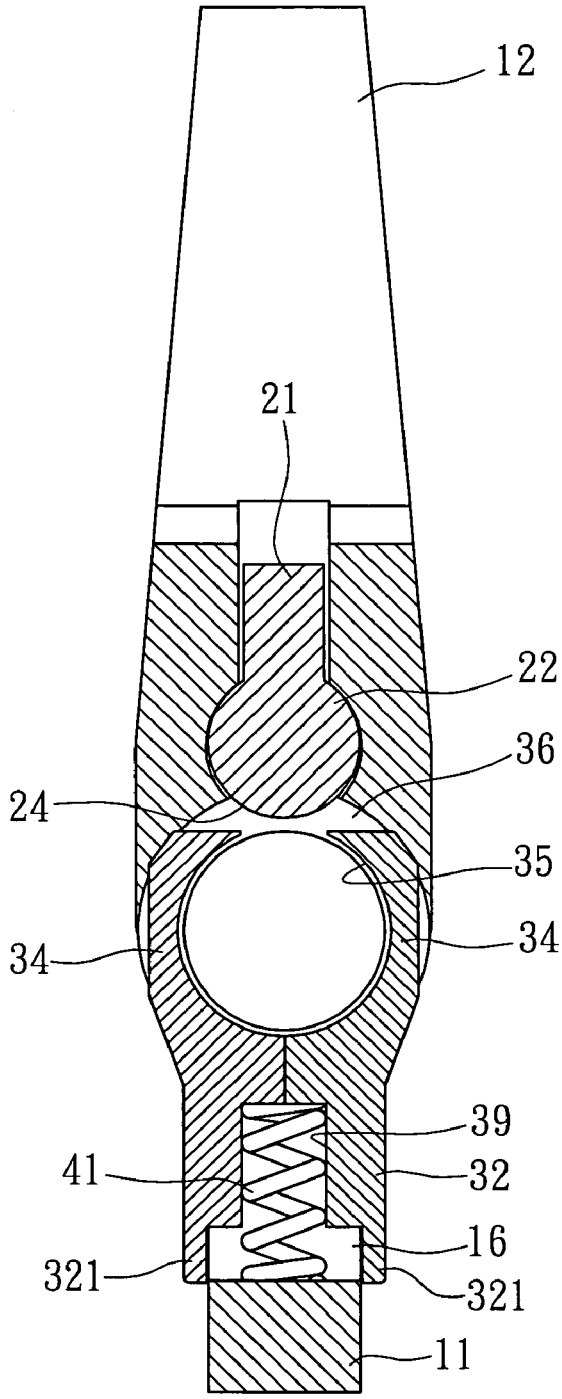
FIG. 3 is a sectional side view of this invention.

In the above mentioned structure of adjustable spanner 10, as shown in FIGS. 2 and 3, the working part 31 is provided in the accommodation slot 16 of the body 11. The screw 36 that is clipped by the clip arm 34 lies in the accommodation slot 16. At this time, the working part 31 that is supported by the elastic part 41 makes the screw 36 wedge the tooth portion 24 of the movable jaw 21, and the tooth portion 24 of the movable jaw 21 is used to wedge to the screw 36, thereby the movable jaw 21 staying stationary.

Figure 4:
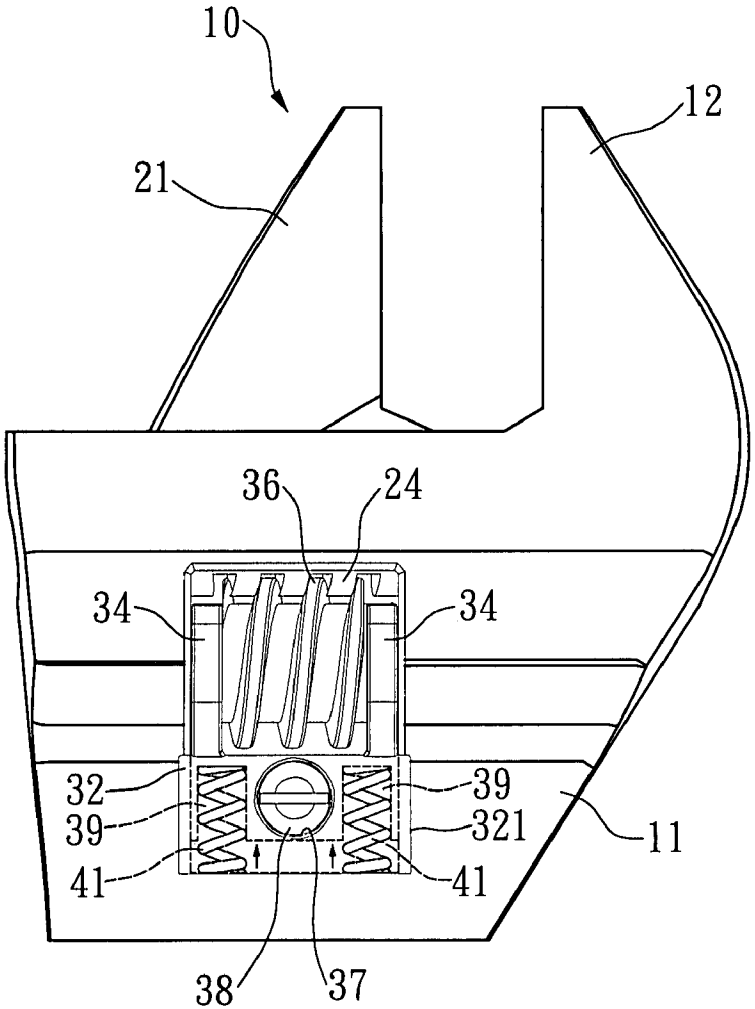
FIG. 4 is a schematic view of a service status of this invention, illustrating a movable jaw that may freely glide.

Regarding operation of the adjustable spanner 10, as shown in FIG. 4, when the user directly pull down the working part 31 to compress the elastic part 41, the screw 36 moves down with the working part 31. When the screw 36 is separate from the tooth portion 24 of the movable jaw 21, because the tooth portion 24 of the movable jaw 21 is not wedged by the screw 36, the movable jaw 21 may be adjusted by the user to freely glide to a predetermined position, thereby an effect of fast adjustment of the movable jaw 21 being achieved.

Figure 5:
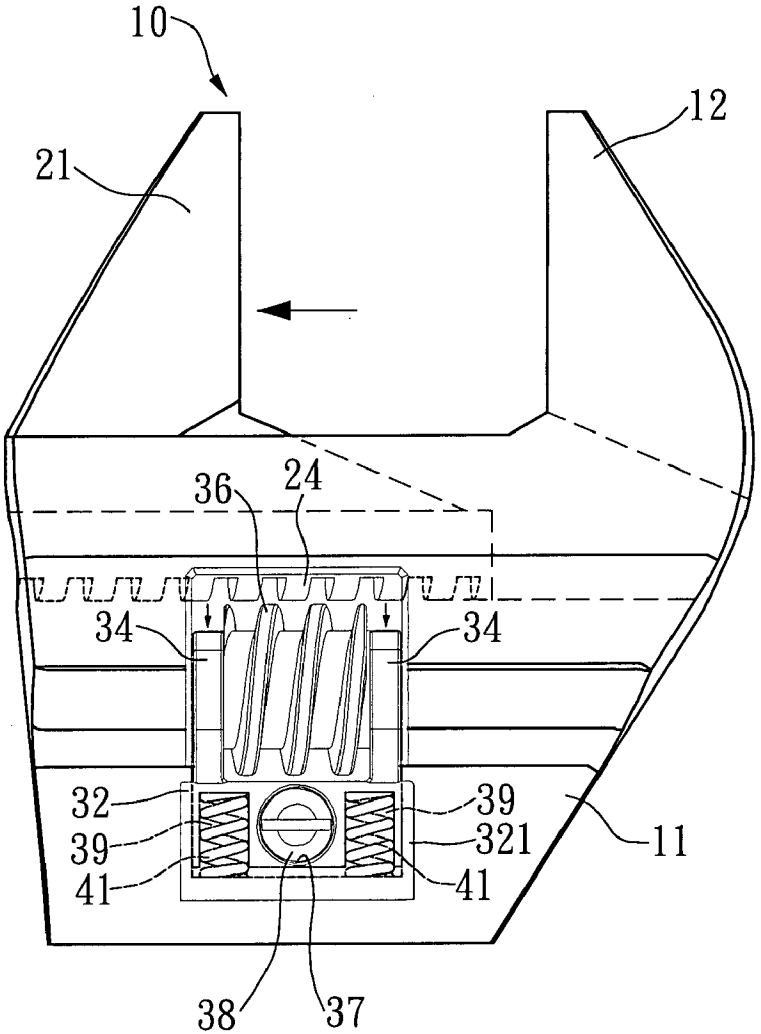
FIG. 5 is a schematic view of a service status of this invention, illustrating the movable jaw that stays stationary.

When the position where the movable jaw 21 lies is determined, exertion of a force to the working part 31 is just stopped and, as shown in FIG. 5, a recovery elasticity of the elastic part 41 is used to make the working part 31 move up by itself and further make the screw 36 wedge to the tooth portion 24 of the movable jaw 21 for fixing the movable jaw 21.

What we especially explain is the screw 36 that wedges to the tooth portion 24 of the movable jaw 21, and thus when the user turns the screw 36, the tooth portion 24 of the movable jaw 21 is driven simultaneously by the screw 36 to make the movable jaw 21 transversally move. Thus, when the adjustable spanner according to this invention is used, the screw 36 of the working part 31 may be in advance separate from the tooth portion 24 of the movable jaw 21 so as to fast adjust the movable jaw 21 for a size of outlined mouth, and next the screw 36 is made to wedge to the tooth portion 24 of the movable jaw 21; at this time, the screw 36 may be turned to fine tune the movable jaw 21 for the size of mouth, thereby a precise size being achieved.

Figure 6:
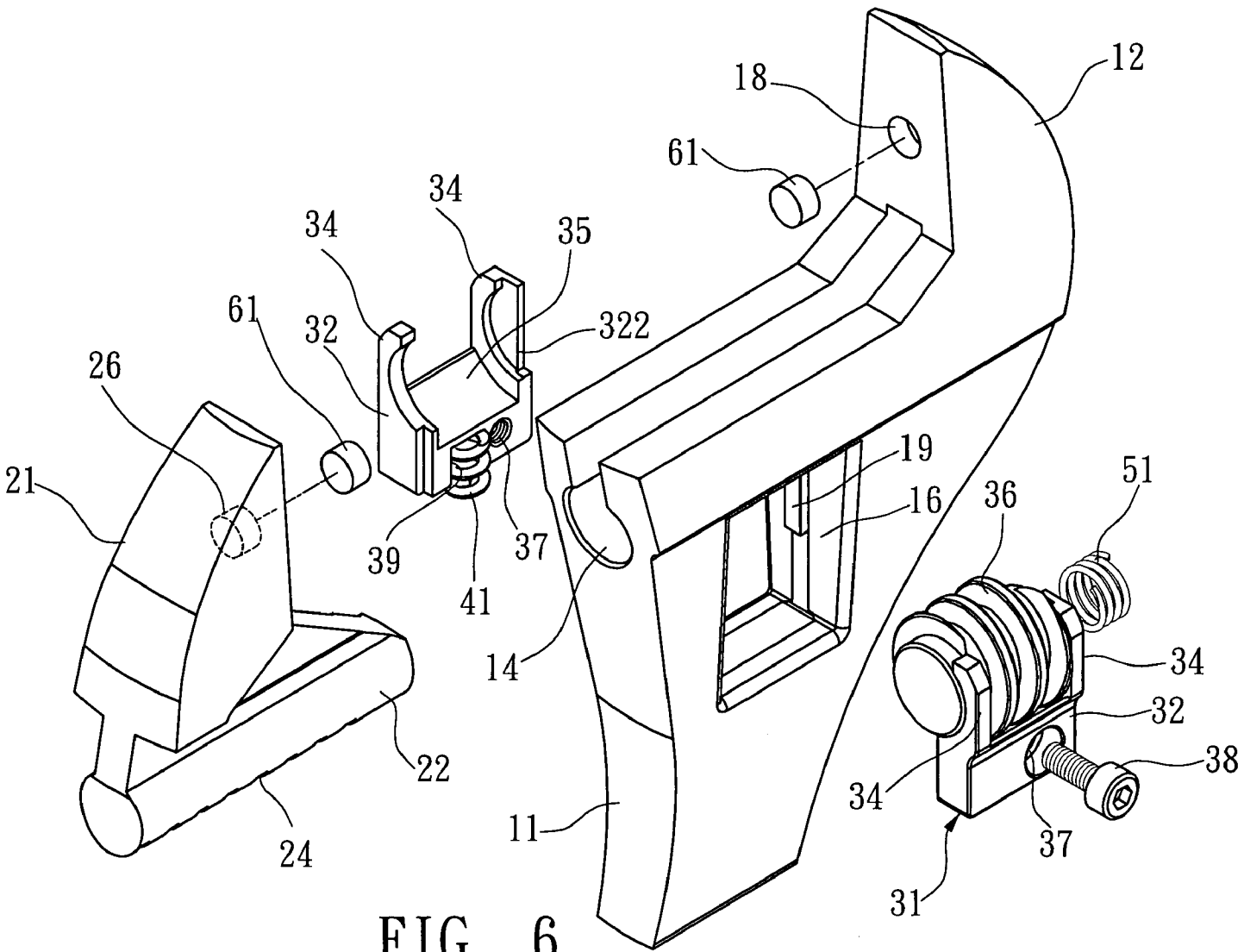
FIG. 6 is a 3D exploded view of a second embodiment of this invention.
Figure 7:
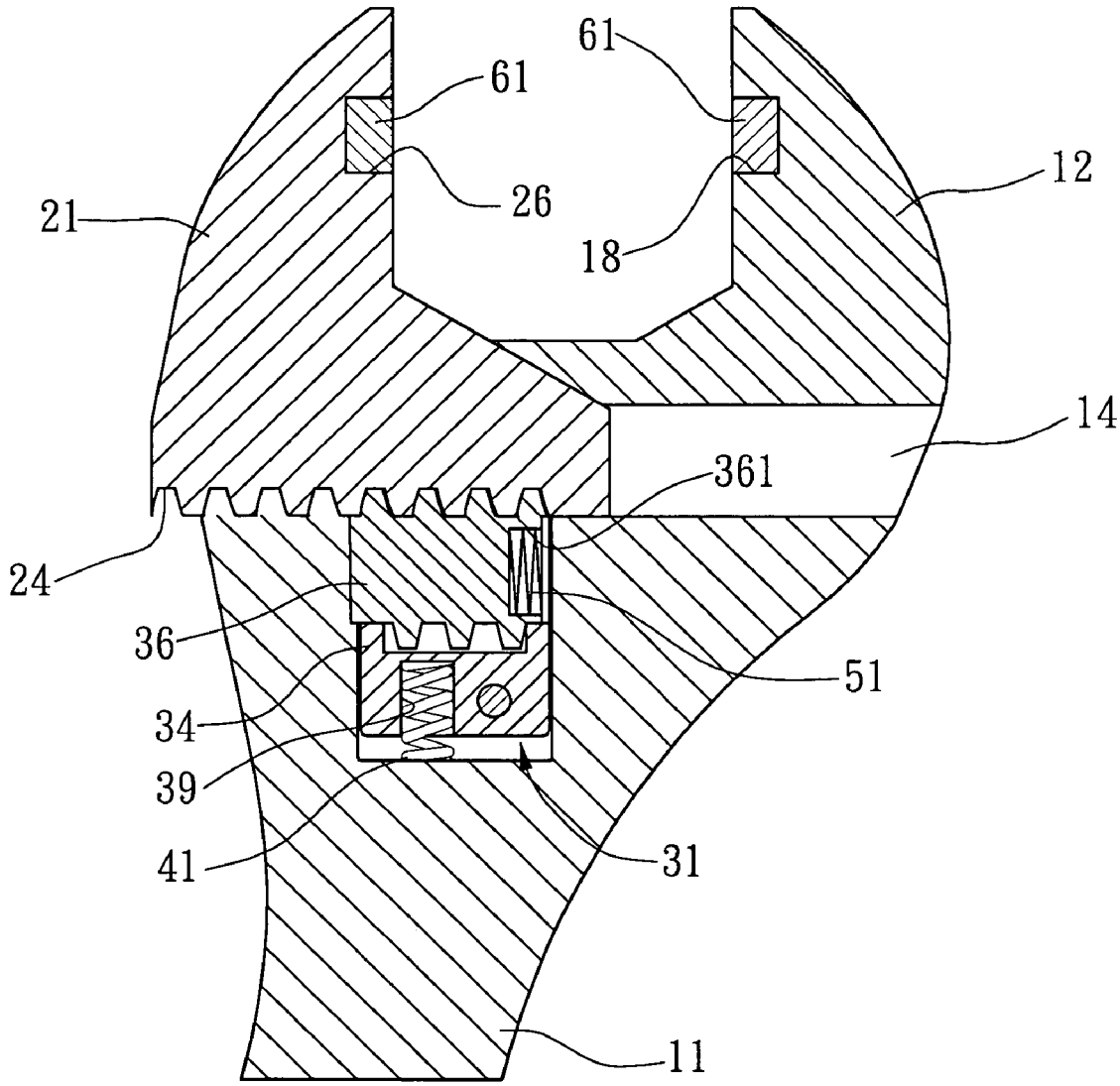
FIG. 7 is a exploded front view of the second embodiment of this invention.
Figure 8:
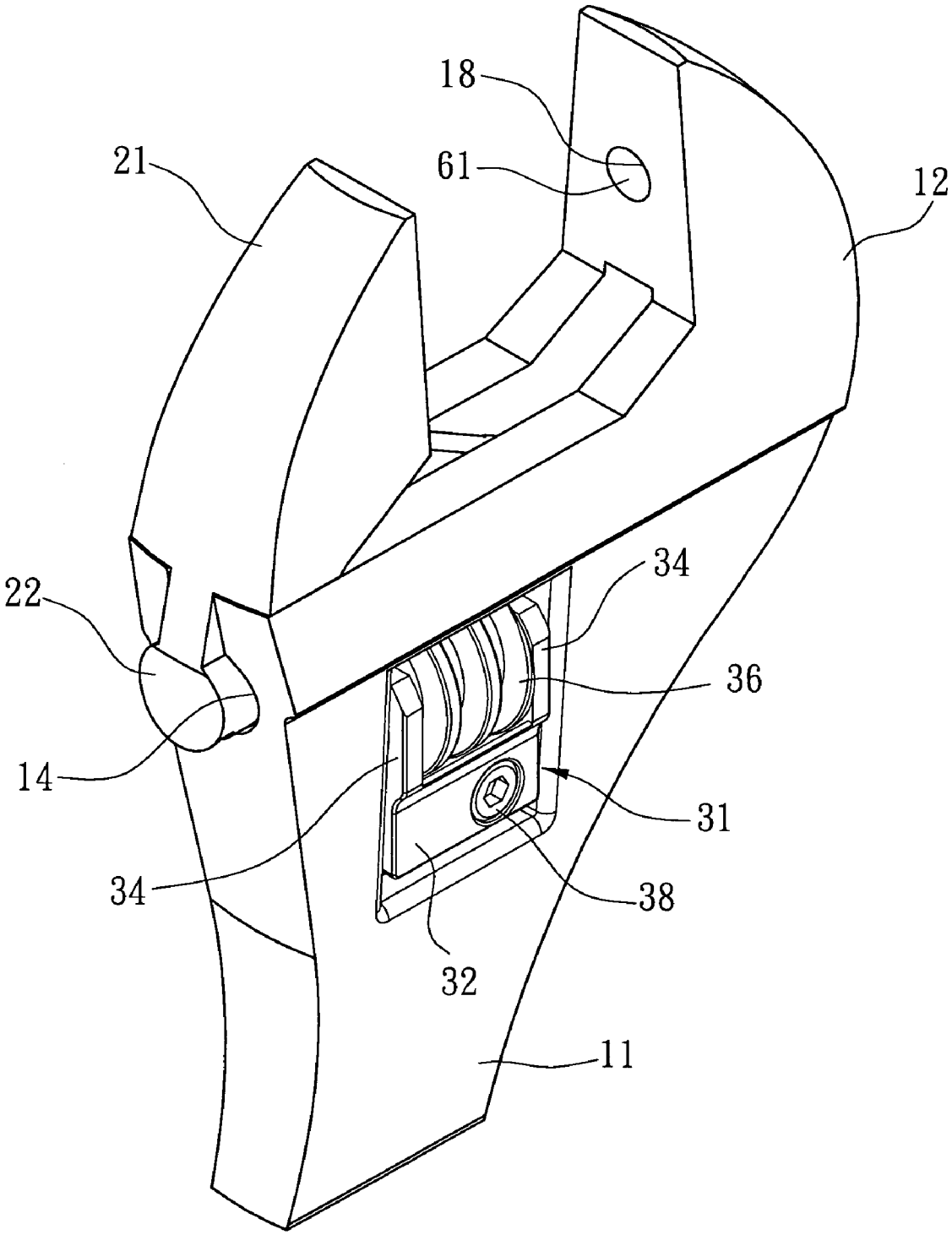
FIG. 8 is a 3D assembly view of the second embodiment of this invention.
Figure 9:
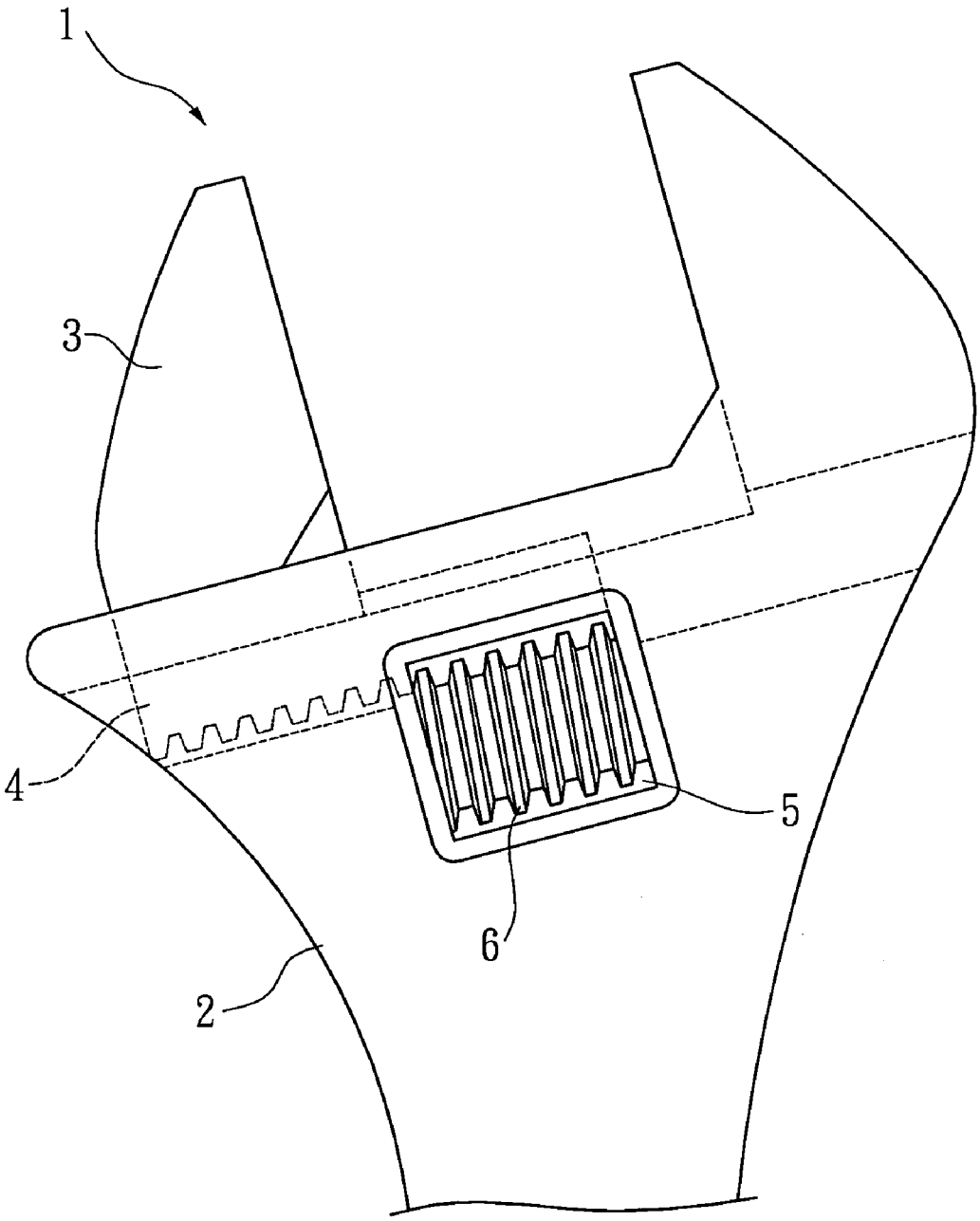
FIG. 9 PRIOR ART
FIG. 9 is a schematic view illustrating a conventional spanner adjustable.

Next, with reference to FIGS. 6 through 8 illustrating a second embodiment of this invention, a groove 361 is formed at an end of the screw 36 for a second elastic part 51 that thereby support a portion between a side of the accommodation slot 16 of the body 11, and the screw 36 so as to give a transversal thrust to the screw 36; thus, a thread of the screw is made to tightly wedge to the tooth portion 24 of the movable jaw 21, thereby the screw 36 being turned to drive the movable jaw 21 for precision and definition.

A lug 19 is provided at a side of the accommodation slot 16 of the body 11. When the two flakes 32 of the working part 31 are connected to each other, a wedge portion 322 is formed at a side of the lug of the accommodation slot 16 corresponding to the working part 31. The wedge portion 322 of the working part 31 is used to wedge to the lug 19 at the side of accommodation slot 16 so as to make the working part 31 not get out of the accommodation slot 16. A first chamber 18 is provided at an operation side of the stationary jaw 12 for a magnet 61, a second chamber 26 is provided oppositely at an operation side of the movable jaw 21, and a magnet of which magnetism is same as that provided in the first chamber 18 is provided in the second chamber 26. Thus, when the screw 36 of the working part 31 is separate from the tooth portion 24 of the movable jaw 21, in a principle of homo-magnetic repulsion, the movable jaw 21 may automatically glide towards the stationary jaw 12 on the glide path 14 of the body 11.

Apparent from what is mentioned above, the effect of fast adjustment of the movable jaw is provided in this invention; the screw may be turned to fine tune the movable jaw for the precise size.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fast adjustable spanner, comprising:

a body of which an action side is provided with a protruding stationary jaw of which a bottom is formed with a glide path communicating with an accommodation slot provided in the body;

a movable jaw provided with a sheath fringe corresponding to the glide path on which the movable jaw may transversally move, in which a tooth portion is provided at a bottom of the sheath fringe;

a working part provided in the accommodation slot of the body to lengthways move, in which a protruding joint portion is provided above the working part and provided with a screw; wherein the working part is formed with two flakes symmetrical to each other and respectively formed with two protruding clip arms and the joint portion is formed with the clip arm on each flake; wherein a stationary hole is provided on each of the two flakes of the working part and a stationary part is used to pass through the stationary hole of each of the two flakes so that the two flakes may be connected to each; wherein a lug is provided at a side of the accommodation slot of the body, such that when the two flakes of the working part are connected to each other, a wedge portion is formed at a side of the lug of the accommodation slot corresponding to the working part, the wedge portion of the working part used to wedge to the lug at the side of accommodation slot; wherein a first chamber is provided at an operation side of the stationary jaw for a magnet, a second chamber is provided oppositely at an operation side of the movable jaw, a magnet of which magnetism is the same as that provided in the first chamber is provided in the second chamber, such that when the screw of the working part is separate from the tooth portion of the movable jaw, by homo-magnetic repulsion, the movable jaw automatically glides towards the stationary jaw on the glide path of the body; and at least one elastic part provided between the working part and the accommodation slot, used to support the working part so as to make the screw of working part wedge to the tooth portion of movable jaw.

2. The fast adjustable spanner according to claim 1, wherein at least one longitudinal groove is formed in the working part for the elastic part.

3. The fast adjustable spanner according to claim 1, wherein an exterior portion of which a size is larger than an internal diameter of the accommodation slot is formed at two sides of the working part, and when the working part is provided in the accommodation slot, the exterior portion is close to an outside of the accommodation slot so that the working part cannot get out of the accommodation slot.

4. The fast adjustable spanner according to claim 1, wherein a groove is formed at an end of the screw for a second elastic supporting a portion between a side of the accommodation slot of the body, and the screw.

* * * * *